US007083303B2

(12) United States Patent
Scholz

(10) Patent No.: US 7,083,303 B2
(45) Date of Patent: Aug. 1, 2006

(54) OPERATING THEATER LAMP HAVING ADJUSTABLE DIAPHRAGM

(75) Inventor: Manfred Scholz, Seitingen-Oberflacht (DE)

(73) Assignee: Berchtold Holding GmbH, Tuttlingen (DE)

( * ) Notice: Subject to any disclaimer, the term of this patent is extended or adjusted under 35 U.S.C. 154(b) by 206 days.

(21) Appl. No.: 10/273,423

(22) Filed: Oct. 15, 2002

(65) Prior Publication Data

US 2003/0086267 A1 May 8, 2003

(30) Foreign Application Priority Data

Oct. 22, 2001 (DE) ..... 101 51 978

(51) Int. Cl.
*F21V 11/04* (2006.01)

(52) U.S. Cl. ..... 362/290; 362/277; 362/354; 362/18; 359/234; 359/236; 353/97

(58) Field of Classification Search ..... 362/3, 362/16, 18, 33, 89, 145, 147, 269, 270, 271, 362/272, 273, 274, 277, 279, 282, 284, 290, 362/291, 296, 317, 319, 321, 322, 324, 325, 362/351, 354, 260, 257, 263, 355, 293, 311; 353/97; 359/234, 236, 227, 232
See application file for complete search history.

(56) References Cited

U.S. PATENT DOCUMENTS

| | | | | |
|---|---|---|---|---|
| 188,700 | A * | 3/1877 | von Otter | 362/279 |
| 1,602,289 | A * | 10/1926 | Tanner | 362/280 |
| 3,456,101 | A * | 7/1969 | Rentschler et al. | 362/18 |
| 3,548,186 | A * | 12/1970 | Brock | 362/325 |
| 4,418,378 | A * | 11/1983 | Johnson | 362/97 |
| 4,556,935 | A * | 12/1985 | Lemme | 362/279 |
| 4,602,321 | A * | 7/1986 | Bornhorst | 362/268 |
| 4,800,473 | A * | 1/1989 | Tremblay | 362/279 |
| 4,951,178 | A * | 8/1990 | Shirai et al. | 362/512 |
| 4,991,070 | A | 2/1991 | Stob | 362/223 |
| 5,053,934 | A | 10/1991 | Krebs | 362/281 |
| 5,073,847 | A * | 12/1991 | Bornhorst | 362/293 |
| 5,178,452 | A | 1/1993 | Scholz | 362/319 |
| 5,428,517 | A * | 6/1995 | Behringer | 362/264 |
| 5,488,546 | A * | 1/1996 | Sato et al. | 362/466 |

(Continued)

FOREIGN PATENT DOCUMENTS

DE G 80 17 909.5 3/1981

(Continued)

OTHER PUBLICATIONS

Copy of the German Patent and Trademark Office's Search Report for German patent application No. 101 51 978.8, includes German-English translation, and Certificate of Accuracy.

(Continued)

*Primary Examiner*—Sandra O'Shea
*Assistant Examiner*—Ismael Negron
(74) *Attorney, Agent, or Firm*—Sierra Patent Group, Ltd.

(57) ABSTRACT

An operating theater lamp has at least one lamp body with a discharge lamp, which illuminates a site of an operation via optical means. The illuminance of the operating theater lamp can be changed in the region of the site of the operation by a mechanically adjustable diaphragm means. The adjustable diaphram means has adjustable lamellae that extend along a longitudinal axis of at least one discharge lamp. The adjustable lamellae pivot about a longitudinal axis. The adjustable diaghragm means include openings that restrict a maximum dimming effect of the adjustable diaghrahm means.

2 Claims, 2 Drawing Sheets

U.S. PATENT DOCUMENTS

| | | | | |
|---|---|---|---|---|
| 5,528,475 | A * | 6/1996 | Takahashi et al. | 362/467 |
| 5,733,036 | A * | 3/1998 | Montgomery | 362/283 |
| 6,309,091 | B1 * | 10/2001 | Weissman | 362/279 |
| 6,435,704 | B1 * | 8/2002 | Montet et al. | 362/539 |
| 6,478,459 | B1 * | 11/2002 | Ui | 362/512 |

FOREIGN PATENT DOCUMENTS

| | | | |
|---|---|---|---|
| DE | 34 32 745 | A1 | 6/1986 |
| DE | 299 23 014 | U1 | 7/2001 |
| EP | 0 001 403 | A1 | 4/1979 |
| EP | 0 468 287 | A2 | 1/1992 |
| FR | 66 975 | E | 11/1957 |
| FR | EP 1 113 221 | A1 | 11/2000 |
| GB | 2 240 167 | A | 7/1991 |

OTHER PUBLICATIONS

Translation of European Search Report dated Apr. 21, 2004 relating to European Patent Application No. 02 016 759.9.
European Search Report dated Apr. 21, 2004 relating to European Patent Application No. 01 016 759.9.

* cited by examiner

OPERATING THEATER LAMP HAVING ADJUSTABLE DIAPHRAGM

PRIORITY

This application claims the benefit of priority to German Patent Application no. 101 51 978.8, filed on Oct. 22, 2001, by applicant, Berchtold Holding GmbH.

BACKGROUND

1. Field of the Invention

The present invention relates to an operating theater lamp comprising at least one discharge lamp which is arranged in a lamp body, is made in an approximately cylindrical shape and illuminates a site of an operation via optical means.

2. Description of the Related Art

The sufficient illumination of body cavities or operation channels generally represents a particular problem, since surgeons nowadays demand dimmable operating theater lamps having an illuminance in the region from approximately 60 to 130 klx. These high illuminances are necessary, on the one hand, since the light rays of the operating theater lamp are shaded by the head and the hands of the surgical personnel. On the other hand, for small and deep operation sites, high illuminances are required because the light rays have to be reflected downwardly at the wound edges to illuminate the surgical wound in depth. Approximately 90% of the incident light energy is absorbed by the red body tissue, i.e. only approximately 10% is reflected and reaches into the depth of the wound.

A dimmability of operating theater lamps, for example to a value of 60 klx, is necessary when the site of operation is only shallow or only extends slightly depth-wise. The same applies to the case when human skin is illuminated, which has a substantially higher degree of reflection than the red body tissue. Finally, dimmability is required when the operating theater lamp is set such that no shading, or only slight shading, takes place by the surgical personnel.

Usual operating theater lamps have previously been fitted with halogen lamps which can be controlled or regulated in their light emission by electronic dimmers. Here, the change in the light quality, in particular in the color rendition properties by the electrical dimming of the halogen lamps is low. It is, however, problematic that only approximately 8% of the electrical power is converted into light, i.e. more than 90% of the electrical power is converted into thermal energy, which puts stress on the surgical personnel since the lamp body is usually located in direct proximity to their heads. For this reason, operating theater lamps have already been developed with discharge lamps whose energy balance is much more favorable. However, these discharge lamps strongly change the light color with an electrical dimming. An electrical dimming is not possible ac all in some cases.

SUMMARY OF THE INVENTION

It is an object of the invention to provide an operating theater light which does not expose the operating personnel to stress and whose brightness can be matched to the different operating situations.

This object is solved by the features of claim 1 and in particular in that a mechanically adjustable diaphragm means is provided to change the illuminance at the site of the operation and is preferably effective in equal manner along the total periphery of the discharge lamp.

In accordance with the invention, an operating theatre lamp provided with a discharge lamp is provided with a mechanically adjustable diaphragm means, with this diaphragm means preferably not varying in its effect along the total periphery of the discharge lamp. It is hereby ensured that a uniform change in illuminance takes place along the periphery of the discharge lamp at every point on activation of the diaphragm means such that the light rays illuminate the site of the operation uniformly after passing through the optical means.

Advantageous embodiments of the invention are described in the description, the drawing and the dependent claims.

In accordance with a first advantageous embodiment of the invention, the diaphragm means can include a transparent cylinder which has a predetermined transmittance and which is arranged coaxially with respect to the longitudinal axis of the discharge lamp and is movable axially in the direction of the longitudinal axis of the discharge, lamp. This cylinder acts as a light filter acting uniformly in the peripheral direction, with the setting of the filter effect taking place by an axial movement of the transparent cylinder over the discharge lamp. If the cylinder has been completely removed from the region of the discharge lamp, no reduction in the illuminance takes place. If the cylinder is located completely over the discharge lamp, the maximum dimming effect is achieved.

The transmittance of the cylinder is preferably uniform both axially and in the peripheral direction. A particularly uniformly illuminated site of the operation is hereby achieved.

In accordance with a further embodiment of the invention, the cylinder can be connected to an electrical drive which moves the cylinder along the longitudinal axis of the discharge lamp. In this manner it is also possible to achieve the dimming effect in a remote-controlled manner and thereby, for example, to include the dimming function in a control and regulation circuit of a light field control system.

In accordance with a further embodiment of the invention, the diaphragm means is not only effective in the same manner over the total periphery of the discharge lamp, but also over substantially the total axial length of the discharge lamp. The diaphragm means can, for example, include a plurality of adjustable lamellae which extend along the longitudinal axis of the discharge lamp and which are in particular arranged along the periphery of the discharge lamp. The transmission of the diaphragm means can be mechanically modified by adjusting the lamellae, i.e. by pivoting about their longitudinal axes. If the lamellae are completely closed such that they form a cylinder, the dimming effect is a maximum. If they are completely opened such that they are oriented substantially radially to the discharge lamp, the dimming effect is minimal.

In accordance with a preferred embodiment, the lamellae can be made transmissible to light at least regionally, for example in that cut-outs or bores are provided at the lamellae. It is hereby possible to restrict the maximum dimming effect, for example to a value of approximately 50%.

In accordance with a preferred embodiment, a common drive, for example a cam track guide driven by an electric motor, can be provided for the synchronous adjustment of all lamellae. In this manner, all lamellae can be actuated simultaneously and in the same manner such that a uniform dimming effect is achieved.

The diaphragm means, which is arranged in the lamp body, can have a material not transmissible to light with cut-outs, from which the individual lamellae are formed.

Alternatively, a color neutral filter glass, for example gray glass, printed glass or a light filter adjustable in transmission, for example a liquid filter, can be provided.

In the following, the present invention will be described purely by way of example with reference to advantageous embodiments and to the enclosed drawings. There are shown:

DETAILED DESCRIPTION OF THE PREFERRED EMBODIMENTS

Figure 1:
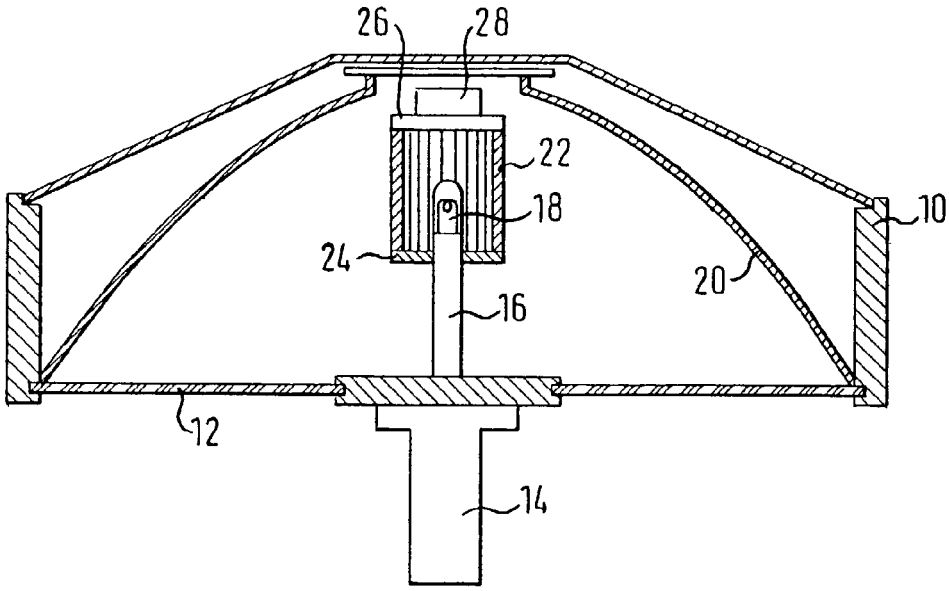
FIG. 1 illustrates a partly sectioned cross-sectional view of a first embodiment.

FIG. 1 shows a lamp body 10 of an operating theater lamp in accordance with the invention which is fastened in a known manner to a lamp arm not shown in any more detail. The lamp body 10 has a transparent cover 12 at its lower side at whose center a handle 14 is fastened. Above the handle 14 a lamp holder 16 is arranged and a discharge lamp 18 is secured to its upper side. Furthermore, a reflector 20, which reflects the light radiated from the discharge lamp 18 and directs it in a desired manner to the site of the operation, is located at the interior of the lamp body 10.

A mechanically adjustable diaphragm means in the form of lamellae 22 arranged next to one another in cylindrical shape is provided to change the illuminance in the area of the site of the operation. The longitudinal axis of each lamella 22 extends parallel to the longitudinal axis of the discharge lamp 18, with the cylinder and the discharge lamp extending coaxially with respect to one another.

Each individual lamella 22 can be pivoted about its longitudinal axis, with a lower part 24 and an upper part 26 being provided for the mounting of the lamellae. In the region of the upper part 26, a cam track guide is provided which cooperates with each individual lamella 22 such that a common adjustment of all lamellae can take place by a drive 28 provided in the region of the upper part 26.

In the position shown in FIG. 1, all lamellae are positioned in the peripheral direction, i.e. the individual lamellae substantially form the shape of a cylinder. The lamellae are pivoted about their longitudinal axes by actuation of the drive 28 such that the light transmitted by the discharge lamp 18 can pass onto the reflector 20 and from there through the cover 12.

Figure 2:
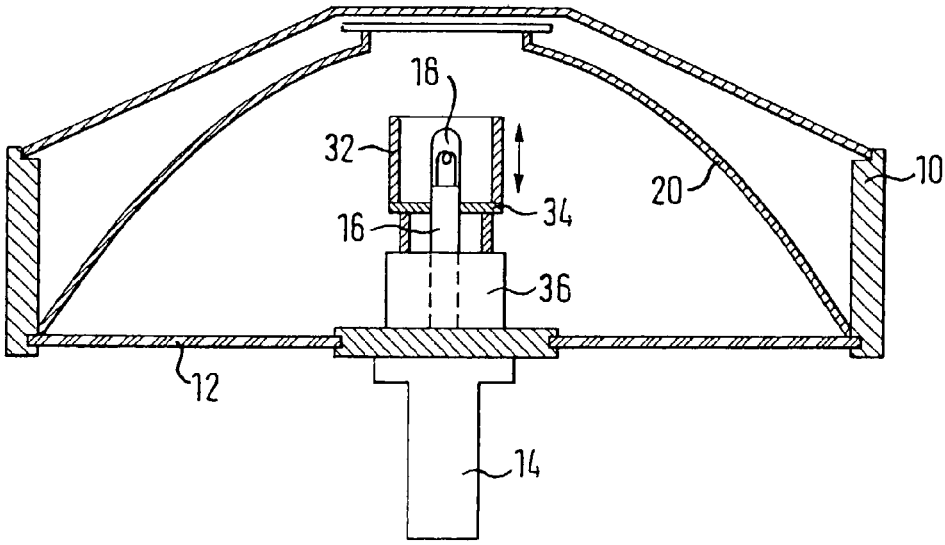
FIG. 2 illustrates a partly sectioned cross-sectional view of a second embodiment of the invention.

FIG. 2 shows a further embodiment of the invention, with the same reference numerals being used for the same components.

With the embodiment shown in FIG. 2, an at least partly transparent cylinder 32, which has a pre-determined transmittance, for example of 50%, is provided as a diaphragm means to change the illuminance in the area of the site of the operation. The cylinder 32 is arranged coaxial with respect to the longitudinal axis of the discharge lamp 18 and is movable axially along the double arrow shown in the direction of the longitudinal axis of the discharge lamp 18.

The cylinder 32 is arranged on a holder 34 which is axially movable about a spindle drive 36. The cylinder 32 is moved in the direction of the arrow by actuating the spindle drive 36 such that the cylinder 32 can cover the discharge lamp 18 with different widths in the axial direction. The cylinder 32 can, for example, be moved completely upwardly such that no dimming effect is provided. In the position shown in FIG. 2, the complete dimming effect is achieved. This amounts, for example, to 50% in dependence on the transmittance of the cylinder.

Figure 3:
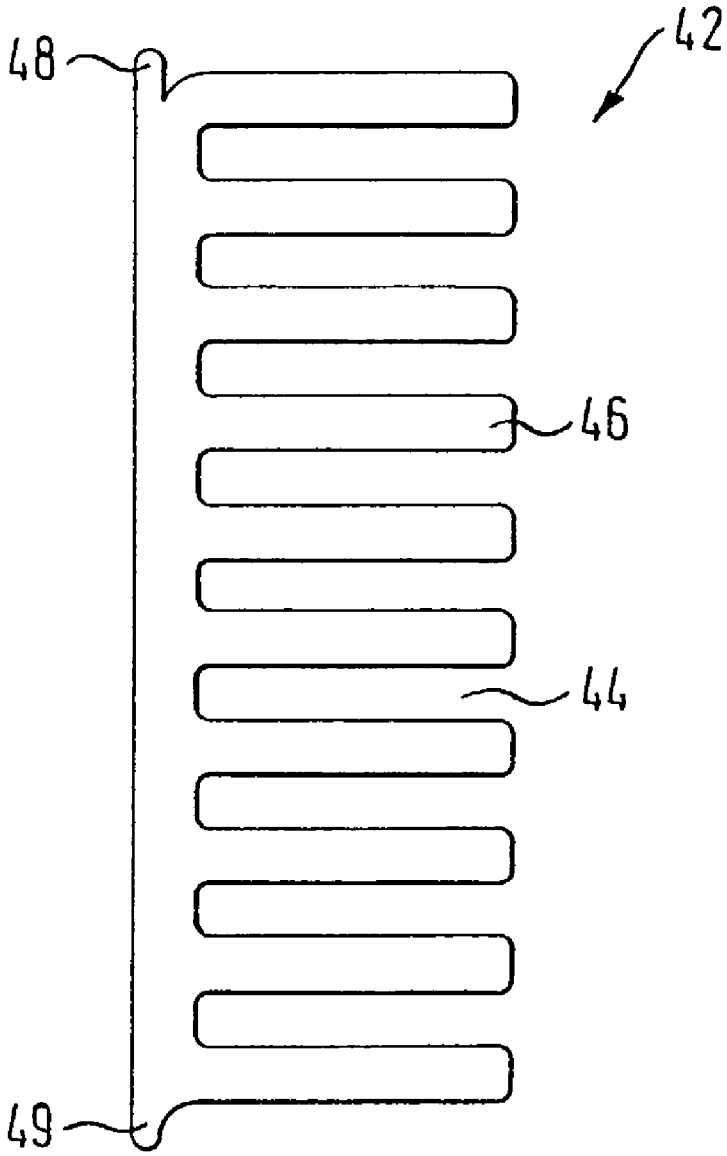
FIG. 3 illustrates a side view of a lamella.

FIG. 3 shows a side view of a further embodiment of a lamella 42 which consists of a substantially rectangular metal sheet which is covered by black lacquer for the avoidance of unwanted reflections and which has a plurality of parallel slits 44 which extend from one longitudinal side of the lamella to close to the opposite longitudinal side. In this manner, the lamella has a comb-like structure with parallel strip-like sections 46. Two spigot sections 48 and 49 are formed at a longitudinal side of the lamella the lamella in the upper part 26 and in the lower part 24.

REFERENCE NUMERAL LIST

10 lamp body
12 cover
14 handle
16 lamp holder
18 discharge lamp
20 reflector
22 lamellae
24 lower part
26 upper part
28 drive
32 cylinder
34 holder
36 drive
42 lamella
44 slit
46 strip-like section
48, 49 spigots

The invention claimed is:

1. An operating theater lamp, comprising:

at least one discharge lamp arranged in a lamp body, and formed in an approximately cylinder shape, and disposed to illuminate a site of an operation via a reflector;

a mechanically adjustable diaphragm means provided in said lamp body for changing an illuminance at said site of said operation;

wherein said adjustable diaphragm means includes a plurality of adjustable lamellae that extend along a longitudinal axis of said at least one discharge lamp;

said plurality of adjustable lamellae being pivotable about a longitudinal axis; and wherein said adjustable diaphragm means includes openings to restrict a maximum dimming effect of said adjustable diaphragm means on said site.

2. An operating theater lamp comprising:

at least one discharge lamp arranged in a lamp body, formed in an approximately cylinder shape, and disposed to illuminate a site of an operation via a reflector;

a mechanically adjustable diaphragm means provided in said lamp body for changing an illuminance at said site; and wherein a transmittance of said adjustable diaphragm means is selected such that a reduction in illuminance of approximately 50% at said site takes place with said adjustable diaphragm completely closed.

* * * * *